US005527006A

United States Patent [19]

Stith

[11] Patent Number: 5,527,006

[45] Date of Patent: Jun. 18, 1996

[54] SEASONAL ORNAMENT HOLDER

[76] Inventor: Rosemarie Stith, 100-26G Darrow Pl., Bronx, N.Y. 10475

[21] Appl. No.: 390,981

[22] Filed: Feb. 21, 1995

[51] Int. Cl.[6] ..... E04G 5/06

[52] U.S. Cl. ..... 248/231.51; 248/229.13; 81/302; 81/424.5

[58] Field of Search ..... 248/231.51, 340, 248/689, 229.13, 229.23; 81/302, 418, 424.5, 427

[56] References Cited

U.S. PATENT DOCUMENTS 3,946,453 3/1976 Torres ..... 81/428

4,965,954 10/1990 Cavazos ..... 81/418

5,019,082 5/1991 Klintmalm ..... 81/418

*Primary Examiner*—Leslie A. Braun

*Assistant Examiner*—Willie Berry, Jr.

*Attorney, Agent, or Firm*—Kirschstein et al.

[57] ABSTRACT

A decorative ornament is supported on a Christmas tree branch by a holder comprising a pair of arms interconnected for movement between open and closed positions. A spring constantly urges the arms to the closed position in which the tree branch is affirmatively gripped by the holder, and in which the ornament is reliably locked in place on the holder.

7 Claims, 1 Drawing Sheet

FIG. 1
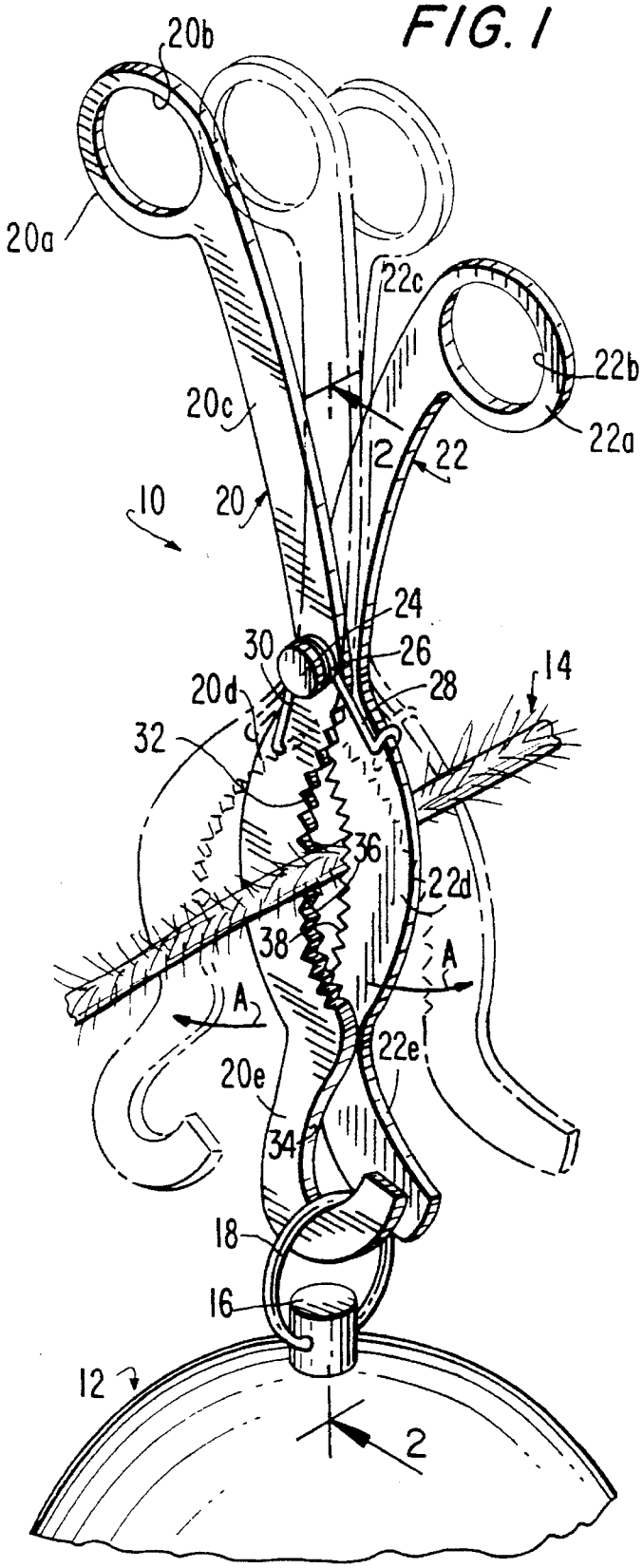
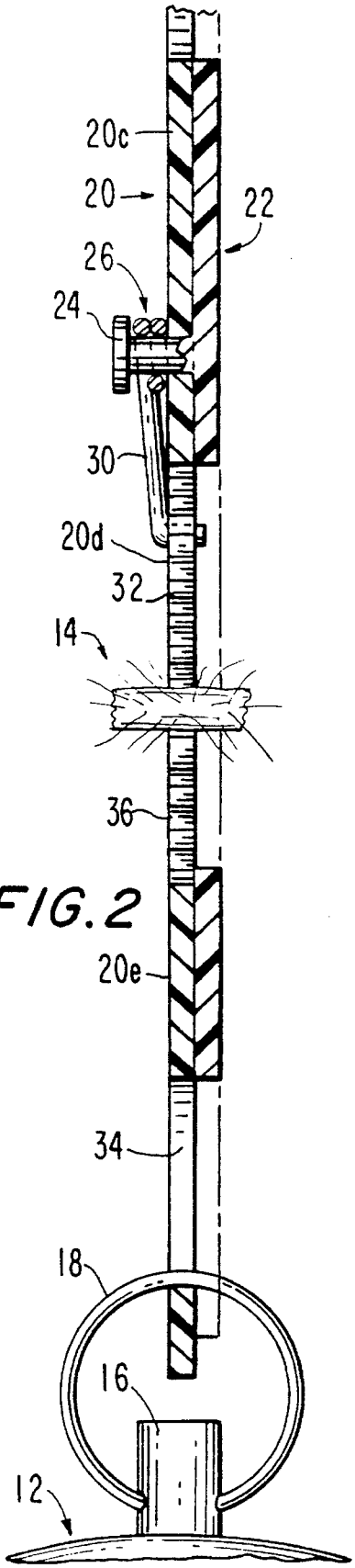
FIG. 2

SEASONAL ORNAMENT HOLDER

BACKGROUND OF THE INVENTION

1. Field of the Invention

This invention relates to an arrangement for supporting a decorative ornament on a generally cylindrical support such as a branch of a Christmas tree.

2. Description of the Related Art

Generally C-shaped hooks are used to suspend a Christmas ornament from a Christmas tree branch. One curved end of each hook is draped over a branch, and the ornament is attached to the opposite curved end of the hook. When the branch is jostled, for example, during tree decorating activities, the hook and the ornament may shift lengthwise of the branch, or turn about the branch, or swing in multiple directions. This movement often requires the ornament to be repositioned, but, more importantly, this movement of the hook and the ornament can lead to the ornament, with or without the hook, working itself free from the hook and falling from the branch to the floor, and possibly breaking.

SUMMARY OF THE INVENTION

Objects of the Invention

It is a general object of this invention to affirmatively support a decorative ornament on a tree branch.

Another object of this invention is to resist shifting and swinging and turning movements of an ornament holder relative to the tree branch.

An additional object of this invention is to prevent an ornament from falling from a tree branch, even when the branch is jostled.

Yet another object of this invention is to prevent the ornament from working itself free from an ornament holder.

Features of the Invention

In keeping with these objects and other which will become apparent hereinafter, one feature of this invention resides, briefly stated, in an arrangement for supporting a decorative ornament on a generally cylindrical support, such as a Christmas tree branch, comprising a pair of arms interconnected for movement between open and closed positions. The arms have handle end portions mutually spaced apart in the closed position and moved toward each other during movement to the open position. The arms also have locking end portions spaced apart in the open position to bound a lock space for receiving at least a portion of an ornament to be supported. The arms also have gripper portions spaced apart in the open position to bound a support space for receiving at least a portion of the tree branch on which the arrangement is to be supported.

In further accordance with this invention, means are provided for constantly urging the gripper portions toward each other to affirmatively grip the branch portion, and for simultaneously constantly urging the locking portions toward each other to lock the ornament portion in place within the lock space. The affirmative gripping of the tree branch by the arrangement ensures that the arrangement and the ornament will not shift lengthwise, or turn about, or swing, relative to the branch. The affirmative locking of the ornament relative to the arrangement ensures that the ornament will not work itself free from the arrangement, and fall from the branch.

According to the preferred embodiment, each handle end portion is provided with a finger-receiving hole. One of the locking end portions has a hook shape. The support space has a generally oval shape in the closed position. For enhanced gripping, the gripper portions have teeth facing each other.

The arms are mounted for pivoting about a pivot located between the handle end portions and the locking end portions. Preferably, the urging means is a coil spring mounted at the pivot and having opposite coil ends bearing against the arms.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a front, perspective view of an arrangement for supporting a decorative ornament on a tree branch, a portion of the tree branch being shown in broken-away view, and with phantom lines depicting the movement of a pair of arms of the arrangement, in accordance with this invention; and FIG. 2 is a sectional view taken on line 2—2 of FIG. 1.

DETAILED DESCRIPTION OF THE PREFERRED EMBODIMENT

Referring now to the drawing, reference numeral 10 generally identifies an arrangement for supporting a decorative ornament, e.g., a ball-shaped Christmas ornament 12, on a generally cylindrical support, e.g., a portion of a branch 14 of a Christmas tree. The ornament 12 has an upper cylindrical post 16 formed with an aperture through which a mounting ring 18 is passed. The ornament 12 can, of course, have other shapes, and, indeed, any decorative display to be suspended from the branch portion 14 is contemplated by this invention. The branch portion 14 can be a real or artificial tree branch and, indeed, any cylindrical support from which the arrangement can be suspended is within the spirit of this invention.

The arrangement 10 includes a pair of arms 20, 22 interconnected for pivoting movement between an open position (shown by phantom lines) and a closed position (shown by solid lines). Arm 20 has a handle end portion 20*a* formed with a finger-receiving hole 20*b*, an intermediate curved portion 20*c*, a curved gripper portion 20*d* curved in an opposite direction from curved portion 20*c*, and a locking end portion 20*b* extending continuously from curved portion 20*d*. Arm 22 has a handle end portion 22*a* formed with a finger-receiving hole 22*b*, an intermediate curved portion 22*c*, a curved gripper portion 22*d* curved in an opposite direction from curved portion 22*c*, and a locking end portion 22*e* which is curved in an opposite direction from the gripper portion 22*d*. Locking end portion 22*e* is a generally C-shaped hook. Preferably, arms 20, 22 are mirror-symmetrical, except at locking end portions 20*e*, 22*e*.

The arms 20, 22 are interconnected at pivot 24 which extends through both arms. The pivot 24 is located at the junction between curved portions 20*c*, 20*d* and 22*c*, 22*d*. A coil spring 26 is mounted at the pivot 24. Spring 26 has a pair of opposite coil ends 28, 30 bearing against the arms 20, 22, respectively, and acting to constantly bias the arms to the illustrated closed position.

As shown in the closed position of FIG. 1, the spring 26 constantly urges the handle end portions 20*a*, 22*a* to be positioned apart of each other; the oppositely-curved gripper portions 20*d*, 22*d* are positioned so as to form a generally oval-shaped, closed, support space 32; and the locking end portion 20*e* overlies the open side of the C-shaped locking end portion 22*e* to bound a closed lock space 34.

In operation, a user places two fingers, preferably the thumb and forefinger, into the apertures 20*b*, 22*b* and moves the handle end portions 20*a*, 22*a* toward each other against the restoring force of the spring 26. The gripper portions 20*d*, 22*d* move apart of each other in the direction of the arrows A. Likewise, the locking end portions 20*e*, 22*e* are moved simultaneously apart of each other in the direction of the arrows A. This movement opens the support space 32 so that the branch portion 14 can be received therein and also simultaneously opens the lock space 34 so that the mounting ring 18 can be slipped over the locking end region 22*e*.

Thereupon, by releasing the handle end regions 20*a*, 22*a*, the spring 26 returns the arms from the aforementioned open position to the closed position. The gripper portions 20*d*, 22*d* now affirmatively grip the branch portion 14. To enhance the gripping action, the gripper portions are respectively provided with rows of teeth 36, 38 or serrations facing one another. The teeth 36, 38 bite into opposite sides of the branch portion 14 in the closed position. The oval-shaped support space 32 allows branch portions of different sizes, diameters and cross-sections to be accommodated therein. Thus, smaller branch portions will be fitted into the opposite end regions of the support space 32, while larger branch portions will be fitted into the central region of the space 32. This gripping action is sufficient to prevent the arms from shifting lengthwise along the branch portion 14, or from turning around the branch portion 14, or from twisting, wobbling or otherwise moving relative to the branch portion 14 and, therefore, provides a very secure anchorage for the ornament 12 to be suspended therefrom.

At the same time, the locking end portions 20*e*, 22*e* now affirmatively lock the ornament 12 on the arms since the overlying locking end portion 20*e* prevents the mounting ring 18 from leaving the closed lock space 34 in the closed position. The ornament can no longer work itself free from the arms, nor uncontrollably move relative to the branch portion 14, thereby reliably preventing the ornament from falling to the floor and breaking.

Each arm is preferably molded of a resilient synthetic plastic material and is of a one-piece construction. The coil spring 26 is preferably constituted of a resilient metal spring wire.

It will be understood that each of the elements described above, or two or more together, also may find a useful application in other types of constructions differing from the types described above.

While the invention has been illustrated and described as embodied in a seasonal ornament holder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An arrangement for supporting a decorative ornament on a generally cylindrical support, comprising:

(a) a pair of arms pivotally interconnected at an interconnection for movement between open and closed positions, said arms having handle end portions at a first end of each of said arms, said handle end portions being mutually spaced apart in the closed position and moved toward each other during movement to the open position, said arms having locking end portions at a second end of each of said arms, said locking end portions being spaced apart in the open position to bound a lock space for receiving at least a portion of an ornament to be supported, said arms having gripper portions located between said second end of said arm and, said pivotal interconnection said gripper portion being spaced apart in the open position to bound a support space for receiving at least a portion of a cylindrical support on which the arrangement is to be supported; and (b) means for constantly urging the gripper portions toward each other for affirmatively gripping the cylindrical support portion, and for simultaneously constantly urging the locking end portions toward each other to lock the ornament portion in place within the lock space.

2. The arrangement according to claim 1, wherein each handle end portion has a finger-receiving hole.

3. The arrangement according to claim 1, wherein one of the locking end portions has a hook shape.

4. The arrangement according to claim 1, wherein the support space has a generally oval shape in the closed position.

5. The arrangement according to claim 1, wherein the gripper portions have teeth facing each other.

6. The arrangement according to claim 1, wherein the urging means is a coil spring mounted at the pivot and having opposite coil ends bearing against the arms.

7. The arrangement according to claim 1, wherein each arm is constituted of a resilient synthetic plastic material.

* * * * *